US005466473A

United States Patent [19]

Forage et al.

[11] Patent Number: 5,466,473

[45] Date of Patent: Nov. 14, 1995

[54] BEVERAGE PACKAGE WITH BAFFLE PLATE TO REDUCE FROTH PRODUCTION

[75] Inventors: Alan J. Forage, Buckinghamshire; Robert Purdham, West Hendon, both of Great Britain

[73] Assignee: Guiness Brewing Worldwide Limited, London, United Kingdom

[21] Appl. No.: 146,410

[22] Filed: Nov. 1, 1993

[30] Foreign Application Priority Data

Nov. 10, 1992 [GB] United Kingdom ..... 9223518

[51] Int. Cl.[6] ..... B65B 31/00; B65D 17/00; B65D 25/00

[52] U.S. Cl. ..... 426/115; 426/124; 426/131; 53/79; 53/474

[58] Field of Search ..... 426/112, 115, 426/124, 131, 106, 397, 398, 394, 474, 477; 53/420, 432, 433, 471, 474, 79

[56] References Cited

FOREIGN PATENT DOCUMENTS 1266351 3/1972 United Kingdom .

OTHER PUBLICATIONS

Webster's Third New International Dictionary, P Gove Ed., G&C Merriam Company, Springfield Mass., 1961 p. 162.

*Primary Examiner*—Donald E. Czaja
*Assistant Examiner*—Curtis E. Sherrer

[57] ABSTRACT

A beverage package has a sealed container 1 containing beer 11 having gas in solution and forming a headspace 16 containing gas at pressure greater than atmospheric. A hollow insert 7 is located in the container and is responsive to a pressure differential developed on opening the top 5 of the container to inject beer and/or gas therefrom into the beer 11 whereby to liberate gas 17 from solution and form froth in the headspace 16. A baffle plate 12 on the insert 7 restrains the liberation of gas 17 to a minor proporation of the volume of beer 11 so that when the beer is poured into a glass, gas can evolve naturally from the beer to produce "sparkle". As an alternative to the beer and/or gas injection bubble initiation, gas from solution in the minor proporation of the volume of beer may be liberated by contact of that beer with a bubble initiating material.

10 Claims, 1 Drawing Sheet

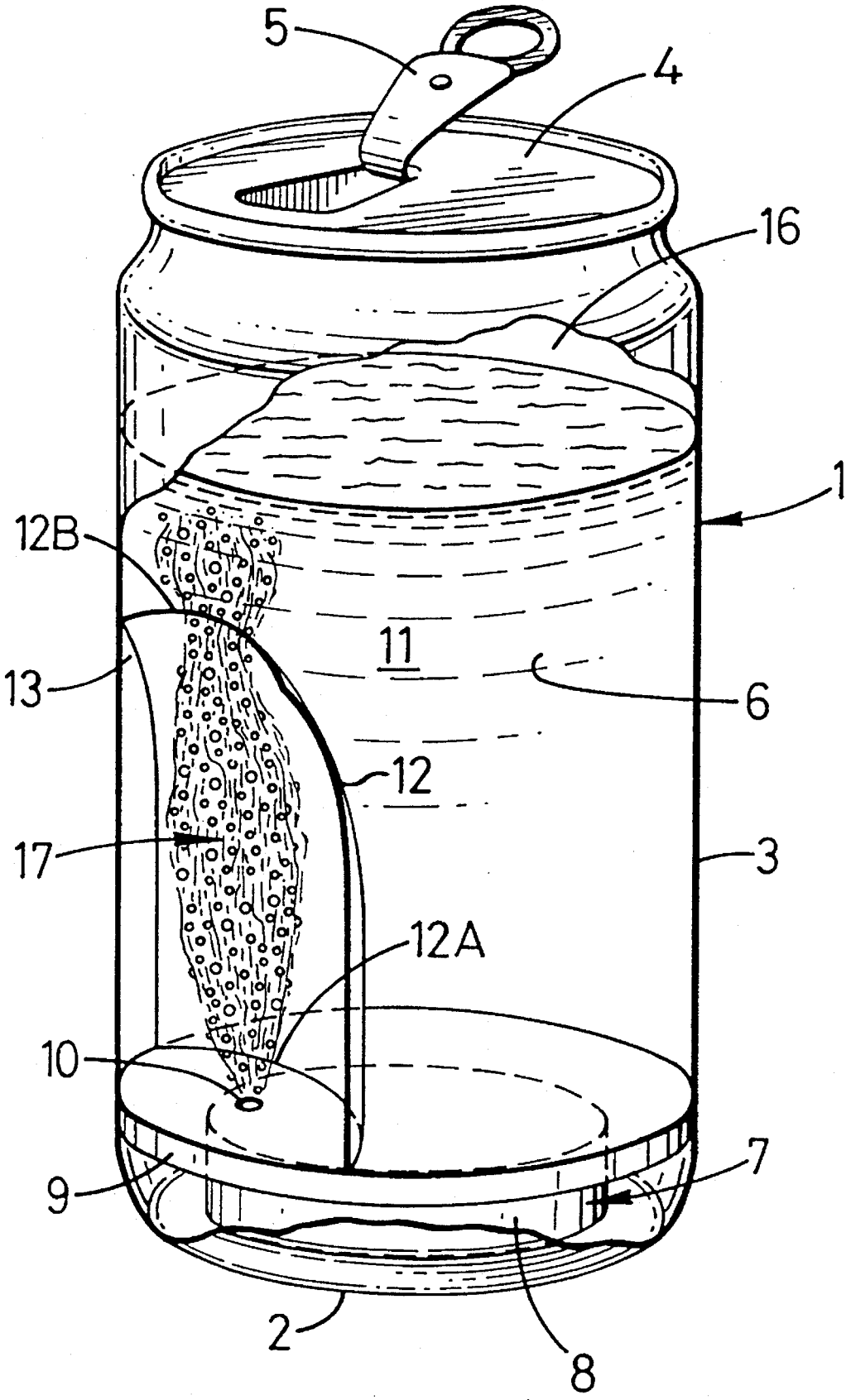
5
4
16
1
12B
11
13
6
12
17
3
12A
10
7
9
2
8

BEVERAGE PACKAGE WITH BAFFLE PLATE TO REDUCE FROTH PRODUCTION

BACKGROUND OF THE INVENTION

The present invention relates to a beverage package. More particularly it concerns beverages containing gas, such as carbon dioxide and/or nitrogen, in solution and packaged in a sealed container which, when opened for dispensing or consumption of the beverage, causes gas to be evolved or liberated from the beverage to form, or assist in the formation of, a head of froth on the beverage. The beverage to which the invention relates may be alcoholic or non-alcoholic; primarily the invention was developed for fermented beverages such as ale, lager, stout or other beer and cider but may be applied with advantage to so-called soft drinks and beverages, or drinks such as spirits, liquors, wine and the like.

Beverage packages are known which comprise a sealed container having a chamber containing the beverage with gas in solution and forming a headspace comprising gas at a pressure greater than atmospheric and in which chamber is located initiator means for liberating gas from solution in the beverage so when the package is opened to open primary headspace to atmospheric pressure, such liberated gas developes a froth or foam in the headspace.

A preferred form of initiator means is responsive to a pressure differential that is developed when the headspace is opened to atmospheric pressure for dispensing or consumption of the beverage and the pressure differential causes beverage and/or gas to be injected from a secondary chamber into a main chamber charged with beverage in the container so that such injection causes gas from solution in the beverage to be released and form bubbles which grow rapidly to rise throughout the volume of beverage in the container and develop a head of froth in the headspace of the container. A further known initiator means comprises a material within the chamber of the container having a surface or struture, such as a micro-porous structure, on or within which the beverage reacts to liberate gas from the solution so that when the headspace of the container is opened to atmospheric pressure bubbles of the gas rise from the surface of the aforementioned material throughout the beverage causing liberation of further gas to form a froth in the headspace. This latter form of initiator means has a relatively slow response in comparision with the rapid response effected by the beverage and/or gas injection initiator means and as such the latter initiator means has found greater preference commercially.

For some beverages, particularly those containing carbon dioxide in solution [with or without nitrogen gas in solution] it is possible for a major part, if not all, of the gas in solution to be evolved from the beverage shortly after the package is opened and the initiator means has reacted to liberate gas from the beverage so that the liberated gas seeds a growth of bubbles throughout the beverage to develop the froth. As a consequence, when the beverage is dispensed from the container into a drinking glass for consumption, it is possible that the absence, or low level, of gas in solution in the beverage will impart undesirable characteristics to the beverage [albeit that such beverage may have a good quality head of froth]. This is particularly the case for so-called light beers or lagers where it is preferred that a reasonable volume of gas, usually carbon dioxide, is retained in solution in the beverage as dispensed in a drinking glass so that such gas can evolve naturally to rise as minute bubbles within the beverage and the latter retains a "sparkle" which is considered desirable aesthetically and can add to the consumers enjoyment and "mouthfeel" of the beverage. It is an object of the present invention to provide a beverage package of the kind generally discussed which alleviates the aforementioned disadvantage of excessive liberation of gas in solution so that the beverage when dispensed will retain a desirable "sparkle" without detracting from the desirable characteristics required for froth development in forming a head on the beverage.

SUMMARY OF INVENTION

According to the present invention there is provided a beverage package comprising a container having a sealed chamber containing beverage having gas in solution and forming a headspace containing gas at a pressure greater than atmospheric pressure; initiator means located within the chamber submerged in the beverage and which in response to a pressure differential developed on opening the headspace to atmospheric pressure, causes gas in solution liberated from the beverage to develop froth in the headspace, and wherein a baffle is provided in the beverage which acts to restrain or impede the development of bubble formation for said froth development by the initiator means to the liberation of gas from a minor proportion of the volume of beverage in the chamber.

Conventionally the initiator means is located at or towards the bottom of the beverage chamber and reacts upon the opening of the container so that energy for the bubble development effected by liberation of gas from solution in the beverage results in a chain-reaction which causes further gas to be liberated from solution and gas bubbles spread throughout the volume of beverage and rise to develop froth in the headspace. By the present invention it is intended that the initiator means from which gas liberation develops is located to one side of a baffle [such as a shield, plate or mesh] which will usually be upstanding in the beverage and serves to impede the growth of the gas bubbles throughout the major volume of beverage in the container and thereby restrain such growth to a relatively minor proportion of the volume of beverage in the container. The aforementioned minor proportions of beverage is preferably less than 30% of the total volume of beverage in the container. As a consequence gas in solution in the beverage will be evolved from what may be regarded as a relatively small proportion, say less than 20%, of the total volume of the beverage in the container to develop a froth in the headspace while a desirable proportion of gas, typically carbon dioxide, will be maintained in solution in a major proportion of the total volume of beverage in the container. Therefore when the beverage is dispensed from the container into a drinking glass for consumption, gas may continue to evolve from solution to maintain "sparkle" and other characteristics considered desirable for the beverage product.

The baffle restrains or impedes the gas liberation from the beverage and preferably serves to direct the gas bubbles as they grow within the minor of proportion of the volume of the beverage towards the beverage surface; this restraint and directional characteristic may be achieved by appropriately profiling or inclining the baffle relative to an upstanding side wall of the container. Preferably the baffle does not form a wall which fully partitions the beverage chamber so that it may be of a structure convenient for location within the chamber; in such circumstances the profile of the baffle should ensure that any gas bubbles which may pass or develop around upstanding side edges of the baffle towards the bottom of the beverage chamber and enter the major proportion of the volume of beverage in the chamber have negligible energy and a minimal effect in liberating gas from solution in that major proportion of the volume of beverage.

Usually the initiator means will be in the form of a hollow insert having a secondary chamber from an aperture of which beverage and/or gas under pressure is injected in response to a presssure differential developed when the headspace of the container is opened to atmospheric pressure [for example in accordance with the disclosure in our Patent specification EP-A-0227213 or GB 1266351]; the aperture through which beverage and/or gas injection is effected will be located to one side of the baffle so that the beverage and/or gas injection is into a minor proportion of the volume of beverage in the chamber. Where the initiator means comprises a material having characteristics, such as a surface structure, to which a beverage is responsive to effect liberation of its gas from solution, the material will be located to one side of the baffle within the minor proportion of the volume of beverage in the chamber. The baffle does not necessarily extend through the beverage to the surface thereof provided that gas bubbles rising above the baffle on opening of the container have insufficient energy to liberate further gas from solution in a significant proportion of the volume of beverage in the chamber, alternatively the upper end of the baffle may be at a relatively shallow depth beneath the surface of the beverage so that high energy gas bubbles surging above the baffle can spread and liberate further gas from solution provided that the total volume of beverage from which gas in solution is liberated is a minor proportion of the volume of beverage in the chamber.

BRIEF DESCRIPTION OF THE DRAWING

The accompanying illustrative drawing which diagrammatically illustrates the package following the opening of the container.

DESCRIPTION OF PREFERRED EMBODIMENT

The beverage package illustrated comprises a conventional form of container such as a light metal can 1 having a circular base 2 on which the package will normally stand, a cylindrical side wall 3 and a circular top 4 which will usually be seamed to the side wall 3 to seal the container. The top 4 is openable, typically by a ringpull 5 [although other conventional means such as a displaceable tag may be provided] for the purpose of dispensing beverage contents of the container.

In the present example the beverage for the package may be considered as a light beer or lager having in solution a mixture of carbon dioxide and nitrogen gases, typically the carbon dioxide content will be 1.75 to 6.0 grams per liter and the nitrogen gas content will be 3% to 5% vols./vol. The term "vols/vol" is well known in the art but a definition of it may be found in our British Patent No. 1588624.

The container 1 forms a primary chamber 6 and prior to fitting and sealing the top 4 and with the container in an upstanding condition, an insert 7 is inserted into the primary chamber 6 through the open top of the container and located on the base 2 at the bottom of the primary chamber.

The insert 7 is of a conventional form having a hollow generally cylindrical drum 8 from which extend diametrically opposed flanges 9. The insert is fitted within the container so that the flanges 9 frictionally engage with the cyclindrical side wall 3 to retain a bottom of the hollow drum 8 on the base 2 of the container. The drum 8 has an aperture 10 through which beverage and/or gas from within the drum is intended to be injected under pressure into beverage 11 with which the primary chamber 6 is charged; such injection of beverage and/or gas may be effected by means which is now well known in the art, for example as discussed in our Patent specifications EP-A-0227213 or GB 1266351.

Located on the insert 7 is a baffle 12 which extends upwardly within the primary chamber 6. The baffle 12 will usually be in the form of a plastic plate or shield which projects upwardly in flange-like manner on the insert. Usually the baffle 12 will be fitted to the insert 7 subsequent to the latter being fitted within the container 1 although it is possible for the insert to be fitted within the container whilst carrying the baffle and in this latter arrangement the baffle may be formed integral with the insert. Where the insert 7 is fitted to the container whilst carrying the baffle 12 and for convenience of handling such an insert, the baffle may be flexible on the insert so that during fitting of the insert the baffle 12 is displaced to lie generally flat against the upper surface of the insert in a compact condition and following fitting of the insert the baffle is displaced under its own natural resilience to adopt its intended upstanding condition.

In the preferred arrangement illustrated the baffle plate 12 is located on the upper surface of the insert 9 with its lower edge 12A adjacent to the aperture 10 and its longitudinal extent projects upwardly within the chamber 6. The plate 12 is curved over its longitudinal extent so that its upper free edge 12B is positioned adjacent to the cylindrical side wall 3 to form a relatively small gap 13 with that side wall. In addition the baffle plate 12 is of generally arcuate shape in lateral section so that the aperture 10 is partly encircled by the arcuate edge 12A of the baffle. Relatively small clearances may be provided between the respective longitudinally extending side edges of the baffle plate 12 and the parts of the cylindrical side wall 3 to which those side edges are adjacent.

Following fitting of the insert 7 with the baffle plate 12 in the container 1, the chamber 6 is charged with the beer 11 containing gas in solution and thereafter the container is closed and sealed by the top 4 so that a primary headspace 16 in the chamber of the container is at a pressure greater than atmospheric. Pressurization of the headspace 16 may be achieved in conventional manner, for example by dosing the chamber 6 with liquid nitrogen immediately prior to the top 4 being fitted and sealed.

When the sealed package is opened, for example by the ringpull 5 in the top 4 to dispense the beer 11, the headspace 16 is opened to atmospheric pressure and rapidly depressurizes. As a consequence a pressure differential is developed between the interior of the insert drum 8 and the headspace 16 which causes beer and/or gas within the drum to be injected in known manner through the aperture 10 into the beer in the chamber 6. The effect of injecting beer and/or gas from the aperture 10 into the beverage causes gas from solution in the beer to be liberated as indicated at 17 so that the gas bubbles which are developed rise and form froth within the headspace 16. The initial high energy injection of beverage and/or gas through the aperture 10 is directed into a minor proportion, preferably less than 30%, of the total volume of the beer 11 within the container and which proportion is effectively located between concave face presented by the baffle plate 12, the cylindrical side wall of the container and the upper surface of the insert 7. This aforementioned injection seeds the liberation of gas progressively through the aforementioned minor volume of beer to form a bubble surge which is predominantly impeded from developing into the major proportion of the volume of beer 6 by the baffle plate 12. Furthermore the concave profile presented by the plate 12 to the aforementioned minor volume of beverage directs the rising surge of gas bubbles towards the side wall of the container to pass through the gap 13. As the gas bubbles rise from their initial development in the region of the aperture 10 their energy is dissipated. As a consequence it may not be essential for the baffle plate 12 to extend upwardly to the surface of the beverage 11 if the low energy gas bubbles rising from the gap 13 are unlikely to have an appreciable effect in liberating further gas from solution in the beverage 11 above the upper edge 12B of the baffle plate. It will of course be appreciated that the baffle plate 12 may extend to locate its upper edge 12B in the headspace 16. Although the baffle plate 12 partially encloses a minor proportion of the volume of beer 11 in the container from which minor proportion gas in solution is predominantly liberated, it is possible that some gas bubbles will spread laterally of the baffle plate 12 to pass through relatively narrow gaps formed between the longitudinally extending side edges of the baffle plate and the respectively adjacent parts of the cylindrical wall 3. However such gas bubbles as may pass around the longitudinal edges of the baffle plate will expend a major proportion of their energy in traversing the baffle plate so that should these "escaping" gas bubbles have sufficient energy to liberate gas from solution in the major part of the volume of the beer 11 on the side of the baffle plate 12 remote from the aperture 10, this latter liberation of gas may be regarded as negligible.

As a consequence of the baffle plate 12 the froth or foam that is developed in the headspace 16 on opening of the package results from gas which is liberated from a minor proportion of the volume of beer 11 in the package and the baffle plate provides an isolating effect to the gas evolution so that a major proportion of the volume of beer within the container will retain gas, particularly carbon dioxide, in solution. Therefore when the beer is poured from the container into a drinking glass shortly after opening the can, the froth developed by the evolution of gas from the minor proportion of the volume of beverage in the can may provide a desirable head on the beer in the glass. However considerable gas will be maintained in solution in the beer in the glass for such gas to evolve gradually and naturally and present a slight effervescent effect or "sparkle" to the body of the beer—this is considered most desirable for aesthetic quality in lager or light beer and may also enhance the flavour characteristics and mouthfeel of the beer.

Injection of beer and/or gas through the aperture 10 in response to the pressure differential developed on opening of the sealed package effects in prompt liberation of gas from the minor proportion of the volume of beer partially enclosed by the baffle plate 12 and a rapid surge of gas bubbles to develop the froth in the headspace 16. A less rapid response may be achieved by omitting the insert 7 from the container and mounting the baffle plate 12 within the chamber 11 in a similar position, possibly with the bottom edge 12A on the container base 2, to that shown. A bubble initiating material can be located between the concave face presented by the baffle plate 12 and the opposing cylindrical wall part of the container so that the material is within the previously mentioned minor proportion of the volume of beverage in the container. The bubble initiating material can conveniently be located on the concave face of the baffle plate 12. The characteristics of the bubble initiating material are such that gas in solution in the beer which it is in contact with that material will be liberated to form gas bubbles which, when the container headspace 16 is opened to atmospheric pressure rise from the material and are guided by the baffle plate 12 to pass through the gap 13 and form froth in the headspace 16. Bubble initiating material having the aforementioned characteristics is known in the art and as such need not be discussed herein.

We claim:

1. A beverage package comprising a container having a sealed chamber containing beverage having gas in solution and forming a headspace containing gas at a pressure greater than atmospheric pressure; baffle plate means in said chamber and extending upwardly within the beverage, said baffle plate means having upwardly extending longitudinal side edges located adjacent to an upstanding side wall of the container for a minor proportion by volume of the beverage in the container to be located between said baffle plate means and said side wall; initiator means located within the chamber submerged in the beverage and which in response to a pressure differential developed on opening the headspace to atmospheric pressure, causes gas in solution to be liberated from beverage in said minor proportion between the baffle plate means and the side wall for said liberated gas to develop froth in the headspace, and wherein said baffle plate means acts to restrain or impede the development of bubble formation for said froth development by the initiator means to the liberation of gas from a minor proportion by volume of the volume of beverage in the chamber.

2. A package as claimed in claim 1 in which the baffle plate means has an upper end which projects into the headspace.

3. A package as claimed in claim 1 in which the initiator means comprises a material in said minor proportion of the volume of the beverage in the chamber between said baffle plate means and said side wall and the characteristics of which material liberate gas from solution in the beverage in contact with the said material.

4. A package as claimed in claim 1 in which said response of the initiator means causes beverage and/or gas under pressure to be injected into said minor proportions of the volume of said beverage in the chamber between said baffle plate means and said side wall to liberate gas from solution in beverage in said minor proportion.

5. A package as claimed in claim 4 in which the initiator means comprises an insert located in the chamber of the container, said insert having an aperture through which said beverage and/or gas under pressure is to be injected and said baffle plate means is carried by the insert.

6. A package as claimed in claim 5 in which the baffle plate means is carried by the insert to be displaceable into a compact condition against the insert.

7. A package as claimed in claim 5 in which the baffle plate means is formed integral with the insert.

8. A package as claimed in claim 1 in which the baffle plate means presents a concave face which partially encloses said minor proportion by volume of the volume of beverage in the chamber.

9. A package as claimed in claim 1 in which said longitudinal side edges provide clearances with said side wall.

10. A package as claimed in claim 1 in which said minor portion is less than 30% by volume of the volume of beverage in the chamber.

* * * * *